US005933507A

United States Patent [19]

Woolley et al.

[11] Patent Number: 5,933,507

[45] Date of Patent: Aug. 3, 1999

[54] HIGHLY PORTABLE STEREO SOUND SYSTEM COMPRISING MIXING CONSOLE-AMPLIFIER AND SPEAKERS

[75] Inventors: Stephen J. Woolley, Burbank, Calif.; Peter Harries, Linton, United Kingdom; Roger F. Cox, Chino Hills, Calif.

[73] Assignee: Fender Musical Instruments Corporation, Scottsdale, Ariz.

[21] Appl. No.: 08/789,652

[22] Filed: Jan. 27, 1997

Related U.S. Application Data

[63] Continuation-in-part of application No. 08/763,327, Dec. 11, 1996, abandoned.

[51] Int. Cl.[6] ..... H04R 5/00

[52] U.S. Cl. ..... 381/300; 381/388

[58] Field of Search ..... 381/24, 188, 205, 381/76, 150, 386, 390, 395

[56] References Cited

U.S. PATENT DOCUMENTS

| | | | |
|---|---|---|---|
| 2,851,526 | 9/1958 | Maples | 381/188 |
| 3,023,274 | 2/1962 | Shaw | 381/76 |
| 3,370,125 | 2/1968 | Shaw | 381/76 |
| 3,684,831 | 8/1972 | Fullmer | 381/76 |
| 4,052,561 | 10/1977 | Molay | 381/76 |
| 4,450,495 | 5/1984 | Naruki | 381/188 |
| 4,535,870 | 8/1985 | Lindsay | 381/188 |

FOREIGN PATENT DOCUMENTS

| | | | |
|---|---|---|---|
| 60-41396 | 3/1985 | Japan | 381/24 |

*Primary Examiner*—Minsun Oh Harvey

*Attorney, Agent, or Firm*—Oppenheimer Wolff & Donnelly LLP

[57] ABSTRACT

A highly portable stereo sound system comprising mixing console-amplifier and speakers. The mixing console-amplifier has spaced-apart front and back sides which have spaced apart upper and lower regions. The first and second speakers are removably mounted respectively on the front and back sides of the console-amplifier, by mating inserts, sockets and latches on the upper and lower regions. The console-amplifier may be a hollow body molded of synthetic resin for containing electronic sound-system elements, and may have control elements for controlling the electronic sound-system elements mounted on the front side. The speakers may also have a hollow body molded of synthetic resin, and may have a side adapted to project sound. The sound-projecting side of the speaker may be shaped and sized to mate with the front or back sides of the console-amplifier.

46 Claims, 6 Drawing Sheets

FIG. 4.
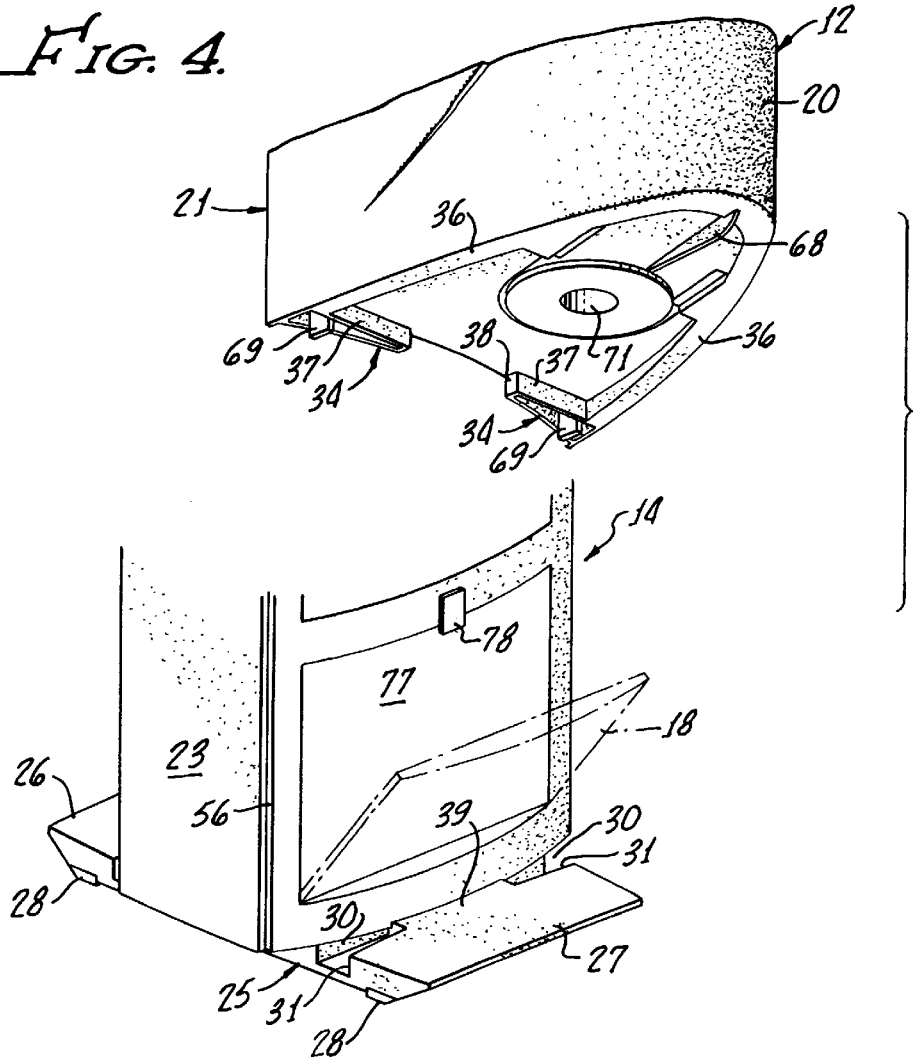
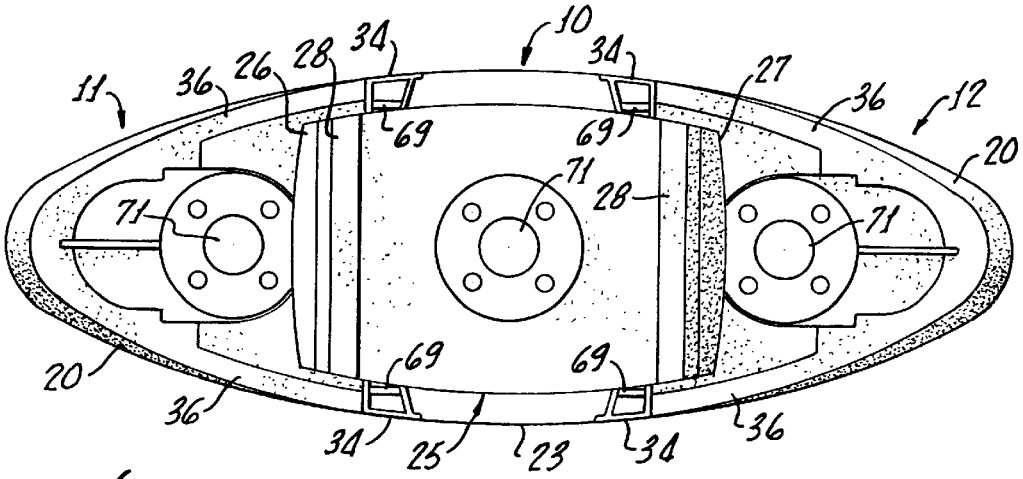
FIG. 5.

FIG. 15.
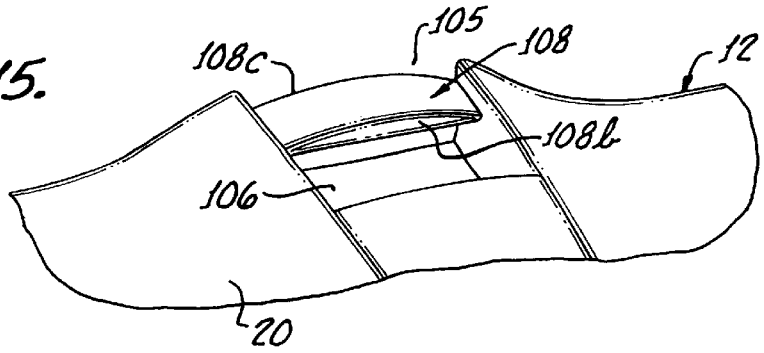
FIG. 13.
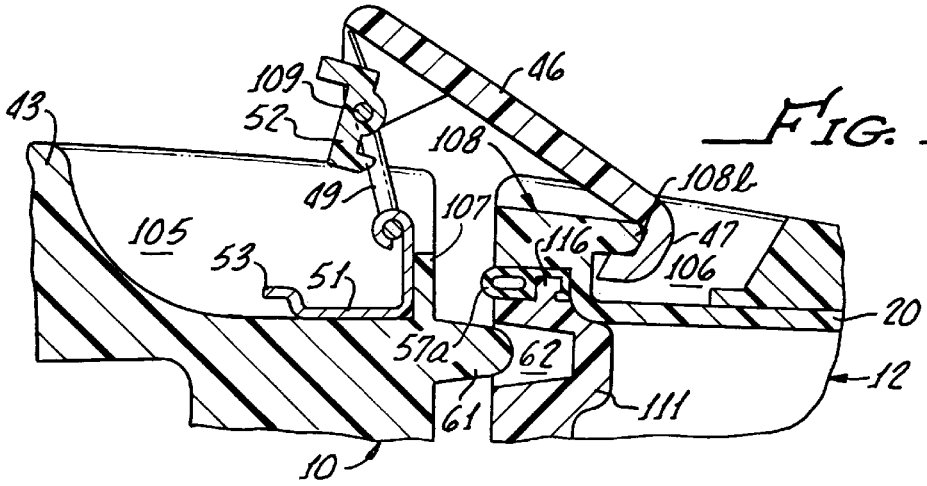
FIG. 14.
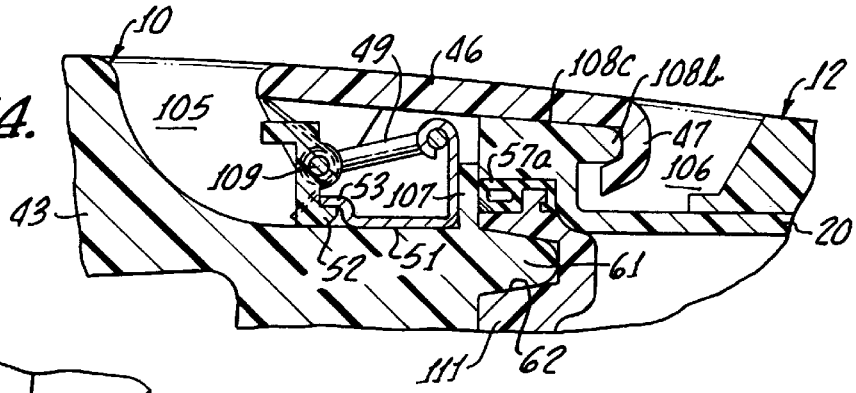
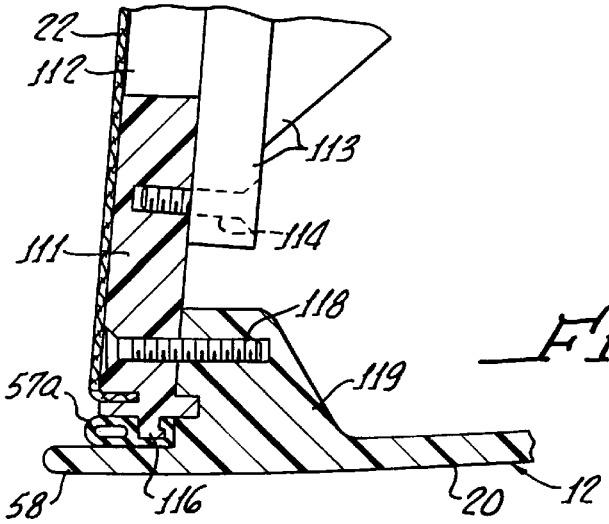
FIG. 16.

HIGHLY PORTABLE STEREO SOUND SYSTEM COMPRISING MIXING CONSOLE-AMPLIFIER AND SPEAKERS

CROSS-REFERENCE TO RELATED APPLICATION

This application is a continuation-in-part of our patent application Ser. No. 08/763,327, filed Dec. 11, 1996, now abandoned.

BACKGROUND OF THE INVENTION

The performance sound systems used by rock music groups, and numerous other organizations, have two modes: operational and transportational. The operational mode is of course of great importance, but the transportational mode has much more importance than is generally recognized by sound system manufacturers. The ideal system would be one that is very satisfactory in both modes.

Getting from one performance (gig) location to the next, while carrying the sound system, is often a huge pain for rock music groups. Only a very few travel by private jet and helicopter; most groups go by van, commercial aircraft, bus, train, etc. This often involves going up and down stairs and escalators, through balky doors, etc. It often means standing and waiting—not infrequently in the rain. It always involves trying to get the system there in good condition, with no lost or damaged components.

Once it arrives at the gig site, the performance sound system must be set up in such a way as to maximize the quality of sound generation and projection, and the convenience of operating the controls. And, the set-up must be done in accordance with the particular physical (environmental) conditions that happen to be present. Is the gig on a theater stage? In a gym? In an open-air location? These and other very different types of surroundings mean that the set-ups must be different in order to be optimal for the particular performance.

For example, in a gym it may be optimum to set the speakers on the floor but directed somewhat upwardly. On a stage it may be optimum to mount the speakers on stands, at heights that vary from place to place.

The same is true for the mixing console-amplifier, especially a hands-on one as distinguished from what are called "tote box" mixers (these having fixed settings throughout a performance). Hands-on mixers are conventionally in flat boxes that are mounted horizontally. There is a need for a very different type of hands-on mixer, one that can be mounted at any elevation and can be vertical not horizontal.

The sound system must be powerful—performance caliber as distinguished from something that might be used only in a living room or den of a home. But it is emphasized that "performance" denotes not only rock music gigs but also meetings or gatherings at any place whatever where public address systems are used. There are at least hundreds of different types of such places.

SUMMARY OF THE INVENTION

In accordance with one aspect of the present invention, the sound system comprises two speakers mounted in inwardly-facing relationship on opposite sides of a hands-on mixing console-amplifier tower. The controls of the tower face a speaker, thus are protected. The entire assembly may be transported or stored relatively easily.

In accordance with another aspect of the invention, the speakers are removably secured on opposite sides of the tower in sealing relationship, so as to make the assembly water resistant.

In accordance with a further aspect of the invention, each speaker is very easily assembled with (and disassembled from) one side of the mixer tower. In the preferred embodiment only one latch assembly, and related elements, is used on each side of the tower.

The assembled combination of speakers and tower is, in accordance with another aspect of the invention, sufficiently large and heavy to have much power and to generate much sound volume, but it is sufficiently light—and so shaped and sized—to be carried by a musician as a "suitcase". The preferred weight range of the assembled combination is 40–65 pounds. The preferred size of the assembled combination is about 30 inches long by about 19 inches high by about 12 inches deep.

In accordance with a further aspect of the invention, the mixer tower has laterally-projecting feet portions that aid and strengthen assembly of the tower with the speakers, that protect the tower and speakers from abrasion and bumps, and that aid in stabilizing the tower in its vertical orientation.

In accordance with another aspect of the invention, the speakers when assembled with the tower are held off the floor, and when disassembled therefrom can sit on the floor in highly stable three-point relationship.

In accordance with another aspect, there are tripod receptacles built into the lower portions of the speakers and tower, and that receive the telescoping vertical stems of portable speaker stands.

In accordance with another aspect, there are lip and plug elements that increase greatly the shear resistance of each joint between tower and speaker. Therefore, and because a locking overcenter latch is provided, the assembled elements are resistant to coming apart when being slammed about while transported.

In accordance with another aspect, the tower has built into it a bin, chamber, or compartment used to transport and store microphones, cables and other components of the sound system.

BRIEF DESCRIPTION OF THE DRAWINGS

FIG. 4 is an exploded isometric view showing the lower portion of one speaker above the lower portion of the mixer tower;

FIG. 5 is a bottom plan view of the fully assembled sound system;

FIG. 13 is a fragmentary vertical sectional view corresponding to FIG. 7 but showing said different embodiment;

FIG. 14 corresponds to FIG. 8 but shows said different embodiment;

FIG. 15 is a fragmentary isometric view, looking downwardly on the top-right portion of FIG. 14 but with the pull element not shown; and FIG. 16 corresponds generally to FIG. 9 but shows said different embodiment.

DETAILED DESCRIPTION OF THE PREFERRED EMBODIMENTS

It is to be understood that each speaker is identical to the other, so that illustrations of portions of one apply also to the same portions of the other. Furthermore, each side of the mixing console-amplifier tower is identical to the opposite side thereof insofar as the mechanical elements are concerned; accordingly, the joints and strengthening elements and feet on both sides of the tower are identical. The two latch mechanisms are identical to each other.

Figure 1:
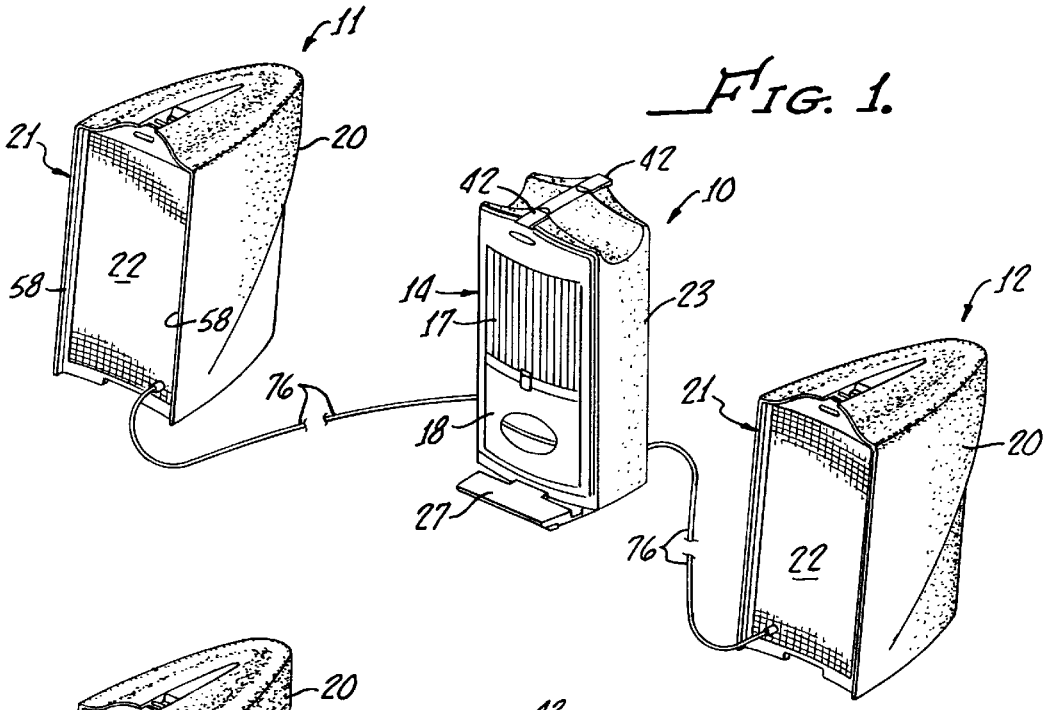
FIG. 1 is an isometric view showing the sound system as set up and resting on the floor at a performance site.
Figure 2:
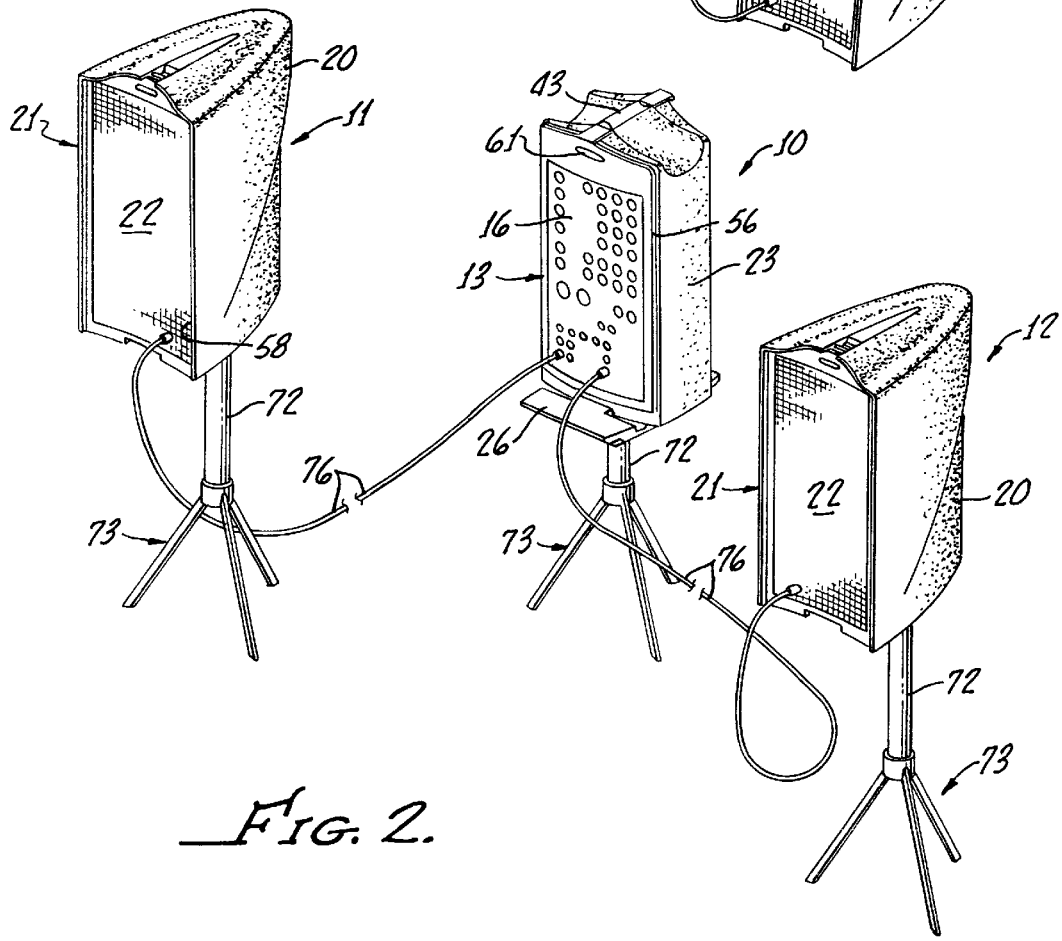
FIG. 2 corresponds to FIG. 1 but shows the opposite side of the mixing console-amplifier, and showing the elements on support stands.

Referring first to FIGS. 1 and 2 in particular, the illustrated performance sound system comprises a mixing console-amplifier 10 and two speakers 11,12. Mixing console-amplifier 10 is shaped as a tower, being preferably vertically elongate. Thus, element 10 is sometimes called a tower, or a mixer-tower, etc. It has front and back sides that are rectangular and are parallel to each other, the front side being shown at 13 in FIG. 2, and the back side being shown at 14 in FIG. 1. Front side 13 has provided thereon the control panel 16 of a hands-on stereo mixing console-amplifier that is contained within the housing of unit 10. The back side 14 has provided thereon, at its upper portion, a heat sink element 17 for radiating heat that is generated by the amplifier portion of the circuitry within mixer tower 10. Beneath the heat sink there is provided a door 18 (FIGS. 1 and 4) to a compartment or bin that contains the microphones, cables and other small auxiliary elements of the sound system.

Each speaker 11,12 has a hollow body 20, the front side 21 of which is "open" except that it is covered by a grill or grid 22 to permit transmission of sound therethrough from loudspeaker elements contained within body 20. The loudspeaker elements are mounted over openings in a baffle that is mounted over the open side, beneath the grill.

Figure 3:
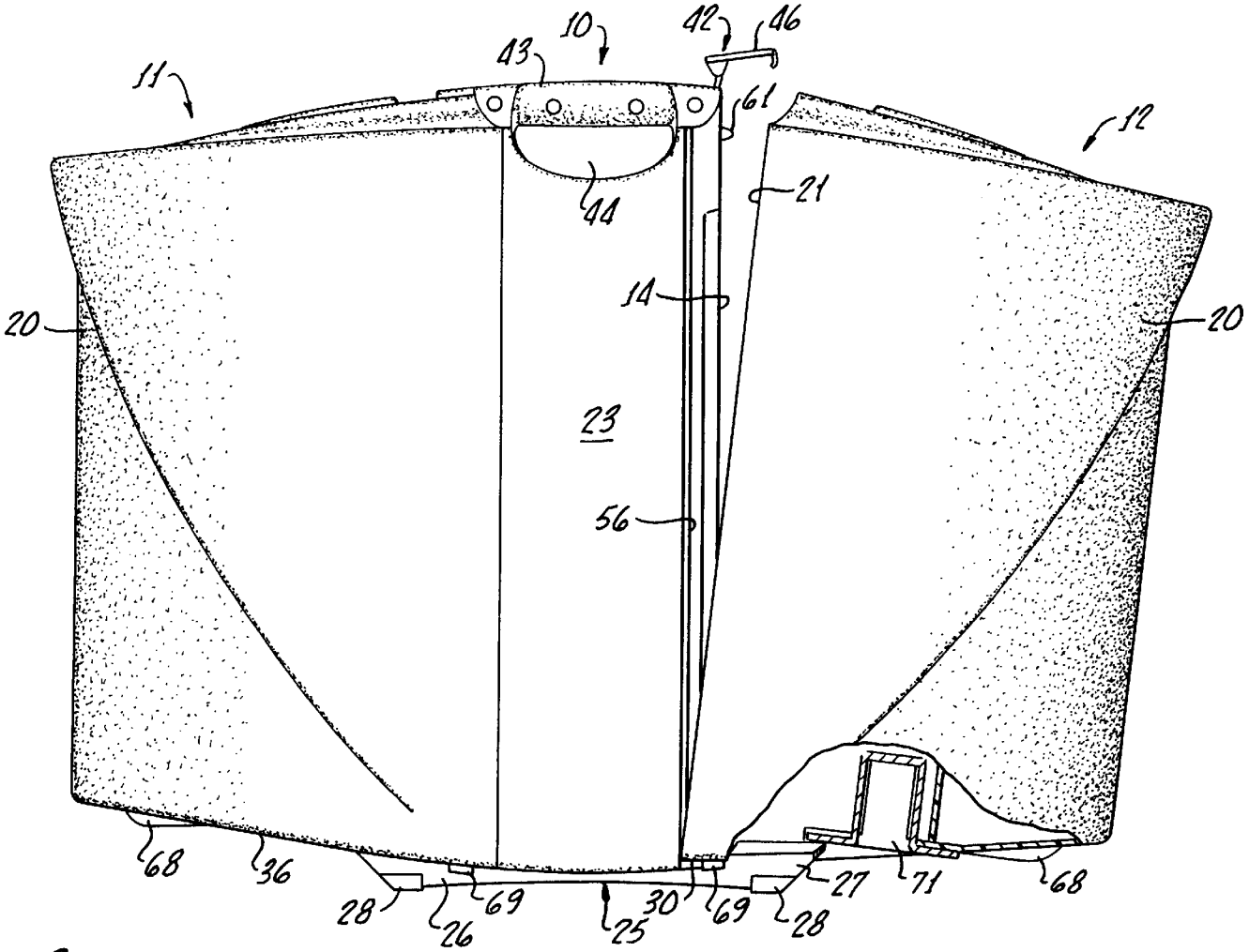
FIG. 3 is a side elevational view showing one of the speakers fully assembled with one side of the mixer tower, and showing the other speaker partially assembled with the other side of the mixer tower.

The front side 21 of each speaker 11,12, at its peripheral region, is shaped and sized to fit together with (mate with) the peripheral region of either the front side 13 or the back side 14 of the mixing console-amplifier tower 10. The relationships are such that, as described in detail below, the "open" front side 21 faces either the front side 13 or back side 14 of tower 10 when the elements 10–12 are secured together for transportation or storage. There is accordingly much protection for the front sides 21 of the speakers, for the control panel 16, for the heat sink 17, and for the door 18, because all of these elements are shielded, covered, concealed and protected as indicated in FIG. 3. Referring to that Figure, during transportation the only things visible are the sides of the speaker bodies 20, the sides 23 of mixer tower 10, and handle and latching and foot elements described subsequently.

The hollow bodies 20 of the speakers 11,12, and the hollow body of the mixing console-amplifier 10, are molded strongly of synthetic resin. They afford a large degree of protection for the interior portions of these elements while not having excessive weight. The speaker bodies (which have internal strengthening flanges) have the strength to not be tympanic.

Detailed Description Of The Apparatus And Method For Joining The Elements 10–12 Together During The Transportational Mode. For Creating Seals, And For Supporting The Individual Elements 10–12 As Well As The Combination Thereof, And For Protecting Against Wear and Shocks As best shown in FIGS. 3–5, there is securely connected to (or integral with) the bottom side of mixer-tower 10 a bottom plate 25 having forwardly and rearwardly projecting feet 26,27. Such bottom plate 25 is formed of strong synthetic resin. Plate 25 serves as a supporting and stabilizing element, as a protector against shocks and abrasion, as a strengthening element, as a means for keeping the mixer-tower 10 above the level of rainwater, and as a part of the connecting mechanism between the mixer-tower 10 and each speaker 11,12.

A bottom surface of plate 25 is substantially perpendicular to the longitudinal axis of mixer-tower 10 (FIG. 3), while the outer end surfaces are inclined (are beveled) upwardly and away from the mixer-tower 10. Because the feet 26,27 project outwardly substantial distances from the mixer-tower, they stabilize it (when it is resting on the floor as shown in FIG. 1)—despite the fact that the tower is vertically elongate and not thick (deep). The beveled ends of the feet minimize the chances that the assembly will become hung up on a stair or other obstruction when the assembly is in the transportational mode.

Figure 6:
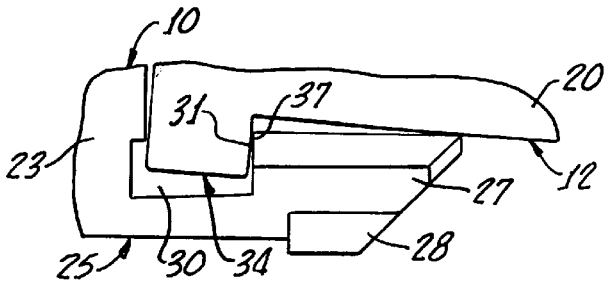
FIG. 6 is a fragmentary view generally corresponding to a lower-central portion of FIG. 3, but in larger scale.

Insert strips 28 are secured in the outer portions of the feet so as to provide effective support for the assembly and for the separated mixer-tower, the lower portions of such strips extending downwardly as best shown in FIG. 6. Such strips 28 are formed of abrasion-resistant synthetic resin.

As best shown in FIG. 4, there are sockets 30 formed in bottom plate 25 at regions adjacent back side 14 of the mixer-tower 10. There are corresponding elements on the other side of the tower, adjacent front side 13, because the connecting and joint portions of the apparatus are identical on each side of the tower and for each speaker (as stated in the early portion of this specification). Each of the four sockets 30 (two adjacent back side 14 and two adjacent front side 13) has a vertical wall 31 (FIGS. 4 and 6). These sockets are sufficiently deep and wide to receive strong insert elements next described.

As best shown in FIG. 4, the bottom wall of each speaker 11,12 has, at its portion adjacent the front side 21 of the speaker, strong insert elements 34 that are respectively shaped and sized to fit snugly into sockets 30. As illustrated, the insert elements 34 are extensions of a downwardly-extending rim portion 36 (wall 36) that encloses the majority of the bottom speaker wall except adjacent the front side 21 thereof. The feet 26,27 are sufficiently narrow to fit within rim portion 36 (FIG. 5).

The relationships are such that, in order to mount each speaker 11,12 onto one side of mixer-tower 10, it is merely necessary to move the speaker (for example, speaker 12) to a position at which its inserts 34 drop into sockets 30 (FIG. 6). This occurs while the speaker 12 is inclined somewhat upwardly and away from mixer-tower 10 (FIG. 3). The speaker 12 is then pivoted upwardly and counterclockwise as viewed in FIGS. 3 and 6 until its front side 21 is adjacent and parallel to the tower side (for example, back side 14 of the tower). When this happens, outer faces 37 on inserts 34 (FIGS. 4 and 6) are adjacent the vertical walls 31 of sockets 30, in a firmly mounted relationship. This prevents the lower portion of the speaker from moving away from the tower.

Furthermore, inner ends 38 of the inserts 34 (FIG. 4) fit adjacent opposite sides of a thick central region 39 of the foot, in straddling relationship. Such straddling cooperates with the below-described beads and other elements to maintain the parts firmly assembled.

It is to be noted that the above-described counterclockwise pivoting of speaker 12 (FIG. 3) is not entirely effected by a musician who puts his/her hands on the speaker 12. Instead, the last portions of the pivoting are effected by the below-described latch, which creates a high mechanical advantage. The latch causes compression of the seals to increase the degree of water resistance of the joint between mixing console-amplifier tower 10 and each adjacent speaker 11,12.

As shown in FIGS. 1–3 and 7–8, there is an over-center latch 42 provided at the center of each side of tower 10, at the top, and at the top-center of the front side 21 of each speaker. The latches 42 are at opposite ends of a strong handle 43 that is built into tower 10, and is best shown in FIG. 3. It has clearance space 44 beneath it to receive the fingers of a person carrying the mixing console-amplifier tower 10 and the speakers 11,12 that are attached to it.

Figure 7:
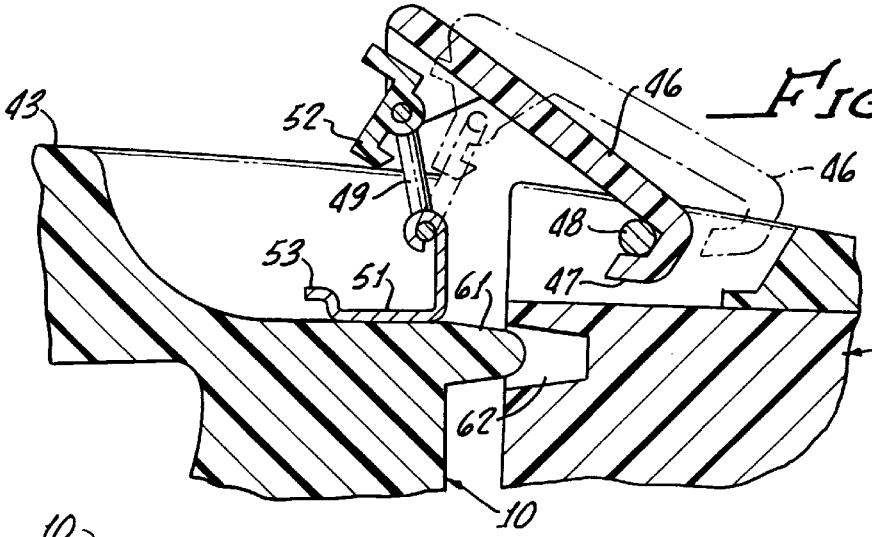
FIG. 7 is a fragmentary vertical sectional view taken longitudinally of the speaker-tower assembly, at the latch and associated shock-resisting elements, the latch being shown in two positions prior to its final closed one.
Figure 8:
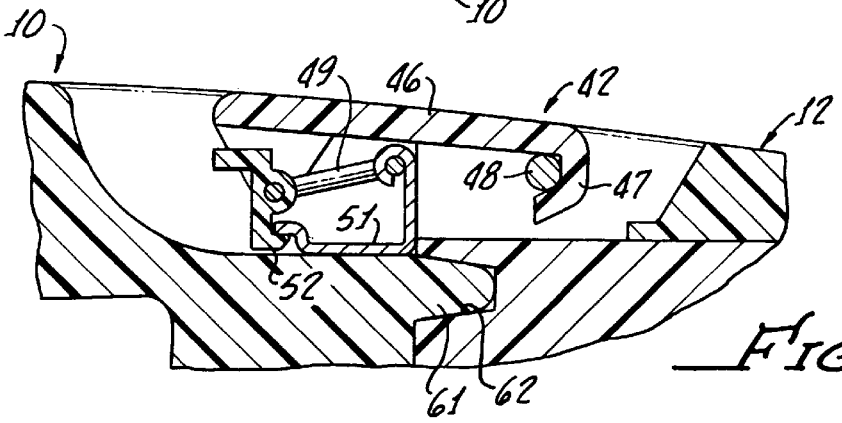
FIG. 8 corresponds to FIG. 7 but shows the latch fully closed, the associated speaker being then fully assembled with one side of the tower.

Referring to FIGS. 7 and 8, each latch 42 has a strong pull element 46 the hooked end 47 of which hooks over a strong cross pin 48 on a speaker. The other end of pull element 46 connects (through triangular connectors) to a crank 49 that pivots about an angle bracket 51 which is strongly mounted on the tower. There is an overcenter relationship when the latch is closed, as shown in FIG. 8. Furthermore, a pivotally-mounted locking crank 52 fits—at its ends—beneath a lip 53 on bracket 51, to prevent accidental release of the latch until the musician intentionally pivots the locking crank clockwise as viewed in FIG. 8.

Figure 9:
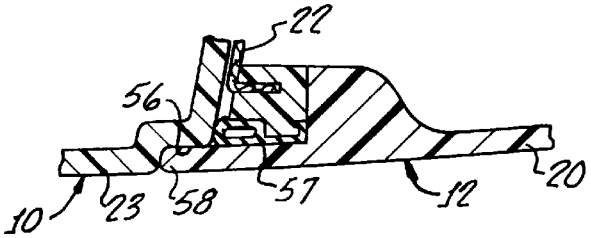
FIG. 9 is a fragmentary horizontal sectional view showing the lip and sealing elements for making the tower-speaker joint strong and water resistant.

Referring next to FIGS. 1–4 and 9, the periphery of the front side 13 and back side 14 of mixer-tower 10 is protuberant, and there is a groove or indentation around the periphery. This groove is numbered 56. Furthermore, there is a seal or gasket 57 provided around the periphery of the front side 21 of each speaker (FIG. 9). Such gasket is adjacent a lip 58 that is provided around the periphery of speaker front side 21. Lip 58 is shaped and sized to receive the protuberant front side or back side of the mixer-tower (FIG. 9). Stated otherwise, lip 58 fits into the above-indicated groove 56 (FIG. 9).

The relationships are such that gasket 57, FIG. 9, when unconstrained, protrudes to the left in such Figure, but is compressed when—during the last portion of the latching operation—lip 58 goes into groove 56 to the illustrated position (FIG. 9).

Referring again to FIGS. 7 and 8, and also FIGS. 2 and 3, there is an integral plug or strengthening element 61 molded at the upper portion of each side of the tower, and which fits into a corresponding recess 62 during the last portions of the pivoting and latching operation of each speaker relative to the tower (FIGS. 7 and 8). Plug 61 is horizontally elongate (in a direction parallel to the mating faces) for increased strength. The plug and recess cooperate with the described lip and groove, with the latch, with the other elements 30,37 and 34, to strengthen the joint between each speaker and the tower. Shock forces, including shear, are resisted.

Further Description Of Different Set-Ups Which May Be Used. And Of Stands And Sockets Referring again to FIG. 3, the left side of that drawing shows the fully-assembled condition of a speaker with the tower. The bottom side of such fully-assembled speaker is spaced above the floor (not shown) on which the bottom plate 25 and its inserts 28 sit. As above described, the "bottom side" of each speaker includes the rim portion 36 (FIG. 4).

This cantilevered manner of hanging the speakers on the front side and back side of the tower 10 facilitates transportation and reduces wear, and helps keep the speakers out of puddles of water. Furthermore, there is a support and wear strip 68 on the under side of a speaker portion that is remote from the tower, it being centrally located as shown in FIG. 4. This is formed of wear-resistant synthetic resin. The support elements 68 on the outer regions of the bottom sides of speakers 11,12 cooperate with the bottom plate 25 and its inserts 28 during transportation. They absorb bumps from the numerous objects that are encountered.

Referring next to FIG. 1, the bottom portions of speakers 11,12 are resting on a floor (not shown), in a three-point support. One of the three points is the above-described support 68 (FIGS. 3 and 4). The remaining two points are feet or legs 69 which are mounted or molded on the speaker bottom, and extend downwardly adjacent and below insert elements 34, as best shown in FIG. 4. Feet 69 are also formed of wear-resistant synthetic resin.

To repeat, feet 69 and support 68 form a three-point support for the underside of each speaker when it is resting on the floor (FIG. 1). The relationships are caused to be such that the face of each speaker then inclines somewhat from the vertical so as to project the sound somewhat upwardly.

There is a receptacle or socket 71 provided in the bottom of each speaker and in the mixer-tower, as best shown in FIGS. 3–5. Each receptacle or socket 71 receives in strong relationship the upper end of the vertical shaft or stem 72 (FIG. 2) of a telescoping tripod apparatus (support stand) 73. With each shaft inserted into a socket, and adjusted to the desired height, the tripod apparatus 73 supports the speakers 11,12 and mixing console-amplifier tower 10 at the desired elevation above the floor.

It is to be understood that there may be a combination of the set-ups of FIG. 1 and FIG. 2. For example, the speakers 11,12 may be in the mounted condition shown in FIG. 2, but the tower 10 may be resting on the floor as shown in FIG. 1.

There are cables 76 extending between tower 10 and each speaker. As illustrated, the cable ends do not connect to the sides of elements 10,12, but instead to the faces thereof that mate with each other. Thus, the openings (sockets) for the cable ends are protected during shipment and storage of the sound system. In the best mode, sockets for the cable ends are located identically in each speaker.

As above stated, during shipment and storage the cables 76, microphones, etc., fit into the compartment 77 (FIG. 4) that is formed in tower 10 below the electronic and heat-sink elements thereof. There is an internal wall (not shown) in the tower that separates the compartment 77 from such electronic and heat-sink elements. The door 18 pivots at the lower edge thereof about a horizontal axis and is closed by a latch 78 (FIG. 4).

Figure 10:
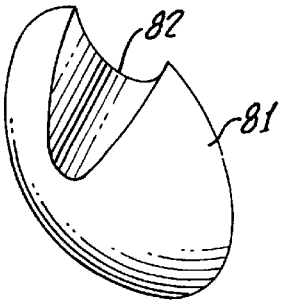
FIG. 10 is an isometric view of one of the mixer control elements.

Referring next to FIG. 10, there is shown the configuration of the majority of control knobs 81 that are part of control panel 16 and that are rotatably mounted on the front side 13 of the mixing console-amplifier tower 10. Each knob 81 has an opening or notch 82 to receive one finger of the operator of the mixer. Each knob controls an aspect of the electronic circuitry contained within the tower.

Second Embodiment

Referring next to FIGS. 11–16, inclusive, all of these figures show the same embodiment, the second embodiment, which is the best mode known to applicants. Some of what is shown in FIGS. 11–16 is the same as what is shown re the first embodiment (FIGS. 1–10). All elements in FIGS. 11–16 that correspond generally to what is shown in FIGS. 1–10—but are not identical to what is there shown—are given the same reference numerals but followed by the letter "a".

Figure 11:
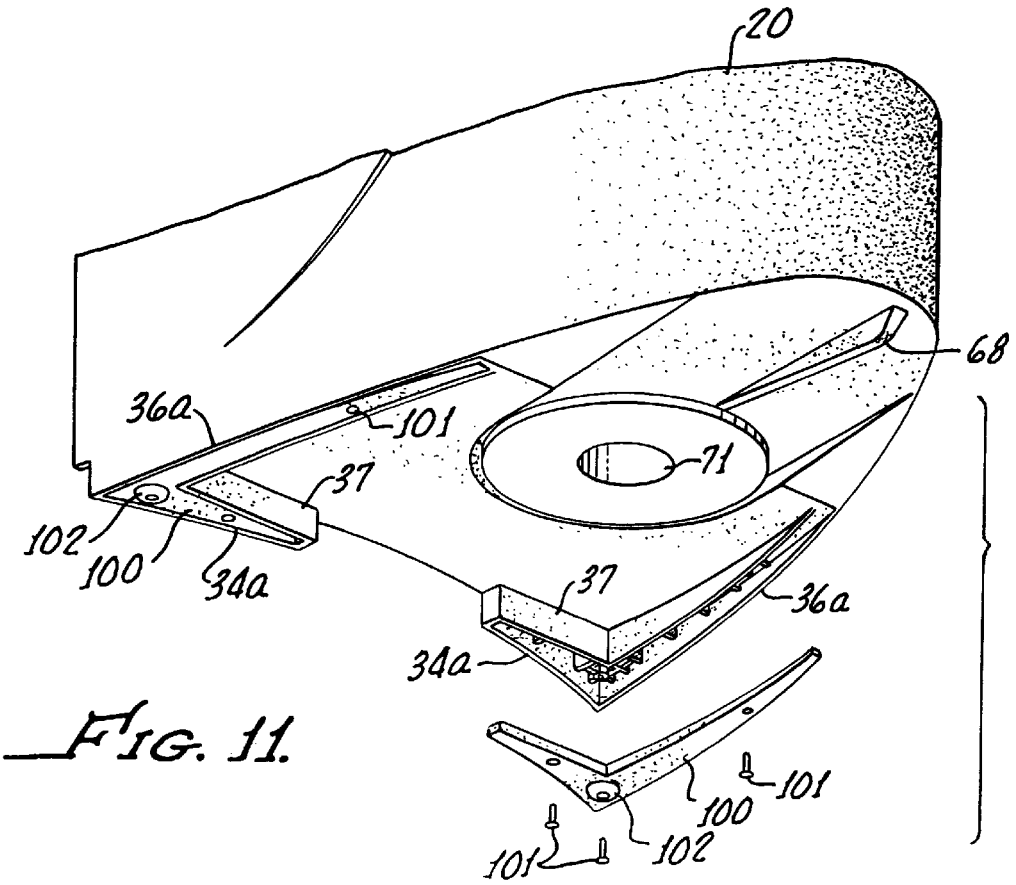
FIG. 11 is a view corresponding to the upper portion of FIG. 4, but showing a different embodiment, a portion of FIG. 11 being exploded.

FIG. 11 shows inserts 34*a* having faces 37, these being sized and shaped to fit into sockets 30 (FIG. 4) adjacent socket walls 31. Inserts 34*a* connect with rim portions 36*a*, to create L-shaped configurations that are strong and rugged.

Inserts 34*a*/rims 36*a* are hollow, being open at the bottom in order to receive L-shaped strengthening fillers 100. Screws 101 secure the fillers 100 firmly in the cavities within elements 34*a*/36*a*.

Figure 12:
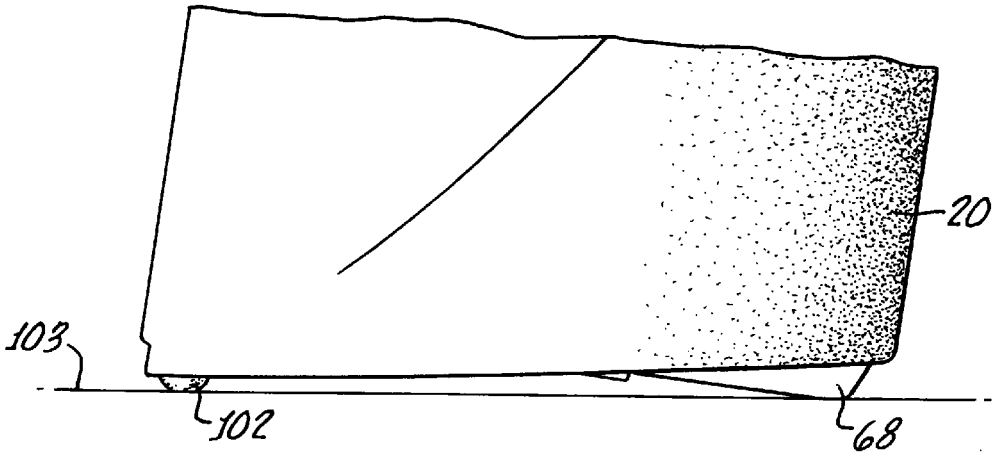
FIG. 12 is a side elevational view of the speaker of FIG. 11, showing the speaker resting on a floor in three-point support relationship.

The fillers 100 are integral with pad (foot) portions 102 that extend downwardly from the corner regions of elements 34*a*/36*a*. Pads 102 cooperate with support 68 in creating three-point supports for the speakers on the floor 103 (FIG. 12). Like support 68, pads 62 and the strengthening fillers integral therewith are formed of wear-resistant synthetic resin. The pads 102 are relatively impervious to damage caused by bumps, etc.

Referring next to FIGS. 13–15, the upper central regions of mixing console-amplifier tower 10 and of each speaker 11–12 have registered grooves 105,106 that extend perpendicular to the mating faces (sides). Groove 105 is formed in the tower body during its molding, and groove 106 is formed in each speaker body 20 during its molding. The grooves are aligned with handle 43.

Groove 105 has a vertical flange 107 at its outer end, that is integral with the tower wall and that provides vertical faces against which bracket 51 and seal 57*a* press. Groove 106 is closed at its outer end—except for a space the depth of which is equal to the thickness of pull element 46—by a strong T-section flange 108 that is integral with speaker body 20. Flange 108 has a thick lip 108*b* that extends away from the tower. It also has a thicker lip 108*c* that extends toward the tower, being adapted to engage flange 107 as shown in FIG. 14.

When the overcenter latch mechanism is shifted from its FIG. 13 position to its FIG. 14 position, the hooked end 47 of pull element 46 pulls with much force against lip 108*b*, closing a left vertical face of lip 108*c* against flange 107, and compressing the seal or gasket that is described above and below.

At the same time, locking crank 52 cams itself (or is manually shifted) past lip 53 of bracket 51 (such crank 52 having an outer beveled face for this purpose). The crank 52 is urged counterclockwise by a torsion spring 109 (FIG. 14) so that the lower end of the crank remains beneath lip 53 until the crank is intentionally manually pivoted clockwise by a person desiring to open the latch. Opening of the latch is completed by moving the parts back to the FIG. 13 position, then lifting pull element 46 to disengage hooked end 47 from lip 108*b*.

Referring next to FIG. 16, which complements FIG. 9, the "open" side of speaker 12 (and speaker 11), that is to say the open side of the molded body 20 of each speaker, is in part covered not only by grill 22 but by a molded synthetic resin baffle 111. Such baffle has at least one, and normally several, circular openings therein over which loudspeaker elements are mounted in outwardly facing relationship. One such opening is shown in part at 112, and one such loudspeaker element is shown in part at 113. One of the mounting screws for the indicated loudspeaker element is shown at 114.

FIG. 16 shows the lip 58 that fits into groove or indentation 56 as described above relative to FIG. 9. Such lip 58 and groove 56 extend vertically up the sides of the speakers and tower (FIG. 2), and also extend generally horizontally across the top except at the central region, such central region being shown in FIGS. 13 and 14.

The seal or gasket 57*a* (FIGS. 16 and 13–14) is mounted on the two vertical sides of baffle 111 and also extends continuously across the top of the baffle. The illustrated means of mounting the seal on the baffle is a flange 116 on the baffle periphery, on which the seal is pressed (popped). From such flange 116, the seal 57*a* extends outwardly substantially past the face of baffle 111 (FIGS. 16 and 13), so that it may be sealingly compressed by the tower 10 as the above-described latch mechanism closes to its FIG. 14 position. Stated more specifically, seal 57*a* is compressed by the tower body face portion that is adjacent groove 56 (FIG. 9), and is also compressed (at the top-center region) by the flange 107 (FIG. 14).

Of course, the described sealing compression of seal 57*a* occurs only when one (or both) speakers 10,11 is assembled with tower 10. Prior to that, the baffle 111, with its seal 57*a* mounted thereon, is inserted into the open side of speaker body 20. Screws 118 are then inserted through the baffle 111 at spaced points therearound, and are threaded into interior protuberances 119 that are molded integrally with body 20 at such spaced points, so as to firmly secure the baffle to the speaker body. The grill 22 (which may for example be plastic or metal mesh, or cloth) is then mounted and covers the speakers and speaker openings, as well as covering the heads of screws 118 (FIG. 16).

Referring to FIG. 14, the plug or strengthening element 61 fits snugly into a recess 62 which is formed in baffle 111. And, the periphery of the baffle is closely associated with speaker wall elements therearound. Accordingly, the plug 61 and the wall of recess 62, and the baffle 111 and the encompassing wall of the speaker, all fit together and cooperate with each other in resisting shock forces (and other forces) including shear, when the assembly is in its transportational mode.

The sound system tower 10 contains various electronic sound-system elements. In the described preferred embodiments, such electronic sound-system elements are combined as a hands-on mixing console and amplifier. Such amplifier is a power amplifier. In another embodiment, the electronic sound-system elements are combined as a power amplifier (without any mixer). In another embodiment, the electronic sound-system elements are combined as a mixer, without the amplifier. Such mixer is preferably a hands-on mixing console.

The foregoing detailed description is to be clearly understood as given by way of illustration and example only, the spirit and scope of this invention being limited solely by the appended claim.

What is claimed is:

1. A highly portable stereo sound system comprising mixing console-amplifier and speakers, which comprises:

(a) a mixing console-amplifier having spaced-apart front and back sides, wherein said front and back sides have spaced apart upper and lower regions, and (b) first and second speakers removably mounted respectively on said front and back sides of said console-amplifier, by relative mating inserts and sockets and by respective latches on said upper and lower regions.

2. The invention as claimed in claim 1, in which each of said speakers has a hollow body and has an opening on one side of said hollow body through which sound may project from at least one individual loudspeaker element within said hollow body, in which said first speaker is so mounted on said front side of said mixing console-amplifier that said opening of said first speaker faces said front side, and in which said second speaker is so mounted on said back side of said mixing console-amplifier that said opening of said second speaker faces said back side.

3. The invention as claimed in claim 1, in which said mixing console-amplifier has many electrical control elements on said front side.

4. The invention as claimed in claim 2, in which said mixing console-amplifier has many electrical control elements on said front side.

5. The invention as claimed in claim 1, in which sealing means are provided to resist ingress of water from the ambient atmosphere into the region between said mixing console-amplifier and at least said first speaker.

6. The invention as claimed in claim 1, in which first and second sealing means are provided to resist ingress of water from the ambient atmosphere into the regions between said first and second speakers and said front and back sides of said mixing console-amplifier.

7. The invention as claimed in claim 2, in which sealing means are provided to resist ingress of water from the ambient atmosphere into the region between said mixing console-amplifier and at least said first speaker.

8. The invention as claimed in claim 2, in which first and second sealing means are provided to resist ingress of water from the ambient atmosphere into the regions between said first and second speakers and said front and back sides of said mixing console-amplifier.

9. The invention as claimed in claim 1, in which a handle is provided on said mixing console-amplifier, for conjoint manual carrying of said mixing console-amplifier and said first and second speakers mounted thereon.

10. The invention as claimed in claim 1, in which first and second means are provided to mount said first speaker on said front side, and said second speaker on said back side, each of said first and second means comprising mating insert and socket means at the lower region of said speaker and side and further comprising latch means at the upper region of said speaker and side.

11. The invention as claimed in claim 1, in which foot means are provided at the bottom of said mixing console-amplifier and are adapted to rest on an underlying support surface.

12. The invention as claimed in claim 11, in which said foot means include portions which project outwardly from the lower regions of said front and back sides of said mixing console-amplifier.

13. The invention as claimed in claim 11, in which said speakers are supported in cantilevered relationship from said front and back sides of said mixing console-amplifier.

14. The invention as claimed in claim 13, in which foot means are provided at the bottom of said mixing console-amplifier and are adapted to rest on an underlying support surface.

15. The invention as claimed in claim 1, in which at least said speakers have means thereon for mounting thereof on support elements, in spaced relationship above the floor.

16. The invention as claimed in claim 1, in which means are provided to removably secure each of said speakers to said mixing console-amplifier at said front and back sides thereof, said means including latch mechanisms, and further comprising mating socket and insert elements.

17. The invention as claimed in claim 1, in which said mixing console-amplifier has a storage chamber therein for reception and storage of microphones and other elements, and in which door means are provided over the entrance to said storage chamber.

18. The invention as claimed in claim 1, in which means are provided at the upper region of said mixing console-amplifier to removably secure each of said speakers to said mixing console-amplifier at said front and back sides thereof, said means including a protuberance and receptacle adapted to mate with each other and sized to strengthen against shear forces the connection between at least one of said speakers and said mixing console-amplifier.

19. A highly portable sound system, which comprises:

(a) a sound-system tower, said tower having a hollow body molded of synthetic resin, said body having front and back sides that are generally parallel to each other, said body containing electronic sound-system elements; said front side having control elements for controlling said electronic sound-system elements, wherein said front and back sides of said body have spaced apart upper and lower regions, (b) two speakers each having a hollow body molded of synthetic resin, each of said speakers having a side adapted to project sound, said sound-projecting side of each of said speakers being shaped and sized to mate with at least one of said front and back sides of said tower body, and (c) mating inserts and sockets and latches on said upper and lower regions to removably mount said two speakers respectively on said front and back sides of said tower body with said sound-projecting sides of said speakers respectively facing said front and back sides of said tower body.

20. The invention as claimed in claim 19, in which said electronic sound-system elements comprise a power amplifier.

21. The invention as claimed in claim 19, in which said electronic sound-system elements comprising mixing elements of a mixing console.

22. The invention as claimed in claim 19, in which said electronic sound-system elements comprise a power amplifier, and said electronic sound-system elements comprise mixing elements of a mixing console.

23. A highly portable sound system, which comprises:

(a) a sound-system tower, said tower having a vertically elongate hollow body molded of synthetic resin, said body having a front side, said body containing electronic sound-system elements, said front side having control elements for controlling said electronic sound-system elements, wherein said front side of said body has spaced apart upper and lower regions, (b) a speaker having a hollow body molded of synthetic resin, said speaker having a side adapted to project sound, said sound-projecting side of said speaker being shaped and sized to mate with said front side of said tower body, and (c) mating insert and socket and latch on said upper and lower regions to removably mount said speaker on said front side of said tower body with said sound-projecting side of said speaker facing said front side of said tower body.

24. A highly portable sound system, which comprises:

(a) a tower element having a hollow body, said body containing electronic sound-system elements, said body having a side on which are mounted control elements for said electronic sound-system elements, wherein said side of said body has spaced apart upper and lower regions, (b) a speaker element having a sound-projecting side, said sound-projecting side of said speaker element being shaped and sized to mate with said side of said lower body, and (c) mating insert and socket and latch on said upper and lower regions to removably mount said speaker element to said tower element in such relationship to each other that said sound-projecting side faces said side of said tower body.

25. The invention as claimed in claim 24, in which handle means are provided for conjoint manual carrying of said mated tower element and speaker element.

26. The invention as claimed in claim 24, in which means are provided to seal against ingress of water into the space between said sound-projecting side and said side of said tower body.

27. The invention as claimed in claim 24, in which said means to removably mount said speaker element to said tower element comprises means to form sockets at the lower portion of said tower element, and means to form inserts at the lower portion of said speaker element, said inserts being adapted to be removably inserted into said sockets to hold said lower portions securely relative to each other.

28. The invention as claimed in claim 27, in which said speaker element, tower element, inserts and sockets are so shaped and related that said inserts are inserted into said sockets when said speaker element and tower element are at a substantial angle to each other, following which said speaker element is pivoted relative to said tower element until said elements are not at a substantial angle to each other.

29. The invention as claimed in claim 24, in which said means to removably mount comprises a single latch to connect the upper portions of said tower element and speaker element.

30. The invention as claimed in claim 29, in which said latch is an overcenter latch.

31. The invention as claimed in claim 30, in which said overcenter latch comprises locking means to prevent unintended unlatching.

32. The invention as claimed in claim 24, in which said speaker comprises a molded synthetic resin body having an open side, in which a baffle plate having at least one opening therein is mounted in said open side, in which a loudspeaker element is mounted on said baffle plate over said opening therein, said open side and baffle plate and loudspeaker element forming said sound-projecting side.

33. The invention as claimed in claim 32, in which a sealing element is mounted around major portions of the periphery of said baffle plate, and in which said molded synthetic resin body has surface means against which said sealing element seats.

34. The invention as claimed in claim 27, in which said inserts are hollow elements in which filler elements are mounted.

35. The invention as claimed in claim 34, in which said filler elements include foot portions to support said speaker on an underlying surface.

36. The invention as claimed in claim 1, having a seal between said front side of said mixing console-amplifier and said first speaker and a seal between said back side of said mixing console-amplifier and said second speaker.

37. The invention as claimed in claim 1, in which said first speaker and said second speaker are removably mounted to said mixing console-amplifier by mating inserts and sockets.

38. The invention as claimed in claim 1, in which said mixing console amplifier has a foot element which projects outwardly from the lower region of said front and back sides of said mixing console-amplifier.

39. The invention as claimed in claim 1, in which said first and second speakers are secured to said mixing console-amplifier by a latch.

40. The invention as claimed in claim 19, having a seal between said sound-system tower and each of said speakers.

41. The invention as claimed in claim 19, in which said speakers are removably mounted to said sound-system tower by mating inserts and sockets.

42. The invention as claimed in claim 19, in which said sound-system tower has a foot element which projects outwardly from the lower region of said front and back sides of said sound-system tower.

43. The invention as claimed in claim 19, in which said speakers are secured to said sound-system tower by a latch.

44. The invention as claimed in claim 23, having a seal between said sound-system tower and said speakers.

45. The invention as claimed in claim 23, in which said sound-system tower has a foot element which projects outwardly from the lower region of said front and back sides of said sound-system tower.

46. The invention as claimed in claim 23, in which said speakers are secured to said sound-system tower by a latch.

* * * * *